United States Patent [19]

Fischer

[11] Patent Number: 4,508,033

[45] Date of Patent: Apr. 2, 1985

[54] TRAVELING PAPER WEB CAPTURING APPARATUS FOR USE WITH A ROTARY PRINTING MACHINE

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 588,661

[22] Filed: Mar. 12, 1984

[30] Foreign Application Priority Data

Mar. 17, 1983 [DE] Fed. Rep. of Germany ..... 3309558

[51] Int. Cl.[3] ..... B65H 25/00; B41F 13/54

[52] U.S. Cl. ..... 101/217; 101/225; 101/228; 101/180

[58] Field of Search ..... 101/228, 225, 227, 217, 101/219, 220, 180

[56] References Cited

U.S. PATENT DOCUMENTS 870,210 11/1907 Wood ..... 101/225 X
1,688,967 10/1928 Holmes ..... 101/228
3,404,627 10/1968 Halley ..... 101/228

FOREIGN PATENT DOCUMENTS 558071 9/1932 Fed. Rep. of Germany .
1408176 10/1975 United Kingdom .

*Primary Examiner*—Clifford D. Crowder
*Attorney, Agent, or Firm*—Frishauf, Holtz, Goodman & Woodward

[57] ABSTRACT

The paper web capturing apparatus includes two capturing rollers, preferably disposed downstream of the last printing station, which when used in a prime-and-verso printing machine both have the same diameter as the printing station cylinders. Both cylinders acting as capturing rollers are provided with a rubber blanket and are driven at approximately the linear speed of the web. They are in continuous engagement with the web of material to be printed. During normal operation, the cylinders of the capturing apparatus effect an enhancement of the printing, in particular of the color printed at the last printing station, and in the event of web tearing the web is wrapped about one of the cylinders, which are positioned resiliently against one another.

4 Claims, 2 Drawing Figures

TRAVELING PAPER WEB CAPTURING APPARATUS FOR USE WITH A ROTARY PRINTING MACHINE

The invention relates to an apparatus for preventing damage to printing stations in the event of tearing of the paper web inside web-feb rotary printing machines having two rollers or cylinders disposed at opposite sides of the web and driven at approximately the linear speed of the web. When winding up the torn web, these rollers are positioned resiliently against one another.

BACKGROUND

An apparatus of this above type is already known from German Patent DE-PS No. 2 156 505. In this apparatus, two rollers are used, disposed following the last printing station spaced apart from both sides of the paper web, and being driven at approximately the linear speed of the web. In the event of a tear in the web, these capturing rollers are positioned resiliently against one another, so that the torn web can be wound about one of the capturing rollers. As a result, the torn web is prevented from becoming wound about one of the cylinders of the printing station, which would cause severe damage to the cylinder and its bearings. The disadvantage of this known capturing apparatus is that a certain response time must elapse between the determination that a tear in the web has occurred and the capture of the torn web by the capturing rollers, because the capturing rollers must be moved together, that is, positioned against one another first, which naturally requires a certain amount of time. Furthermore, the capturing rollers are moved apart during non-problematic or normal operation, to avoid smearing of the freshly-printed web; this has the further disadvantage, however, that during normal operation these capturing rollers have no function whatever to perform.

A paper capturing apparatus is known from German Patent DE-PS No. 558 071 in which the capturing rollers are in constant contact with the web. These rollers are carried along over the web only by friction, however, so that the smearing of fresh ink onto the rollers is unavoidable.

THE INVENTION

It is accordingly the object of the present invention to improve an apparatus of the general type described above such that capturing rollers come into action immediately upon the occurrence of a tear in the web, without any delay, and that they are able to take on additional functions during normal operation yet without smearing the freshly-printed web.

Briefly, a pair of paper capturing rollers is provided, continuously in surface engagement—with the web interposed therebetween—both during normal printing by a printing system of a printing machine, or upon tearing of the web; the paper capturing rollers are driven with a circumferential speed which is at least equal to the linear speed of the web or just slightly higher, but not sufficiently high to cause smearing or misregister of printed subject matter which is being transferred to the rollers. At least one of the rollers has the same diameter as the impression cylinder of the printing station or printing system; and the roller or rollers which is or are in engagement with the web at the side which has just been printed have a surface which is ink-accepting. At least one of these rollers is not rigidly or fixedly supported within the frame of the machine but, rather, its shaft is resiliently located in the machine so that, should torn paper wrap about one or the other of the rollers, the axis can deflect and thus prevent damage to the machine.

The substantial advantages of the paper web capturing apparatus according to the invention derive from the fact that the capturing rollers or cylinders, covered with rubber blankets, are in constant contact with the web. As a result, during normal operation these rollers perform a function of printing enhancement, because after several revolutions the rubber blankets will have taken on ink in the pattern of the subject matter being printed, and this ink can be retransferred in the same pattern from the rubber blankets of the capturing rollers onto the web. Discrepancies in the ink coverage in successive revolutions of the cylinders, which may arise in the printing stations, can be evened out by the capturing rollers or the cylinders provided with rubber blankets. Better wrapping of the torn web about one of the capturing cylinders is also attained, because as already noted these cylinders take on ink after several revolutions, and so the ink on the torn web is attracted to them, or sticks to a rubber blanket, resulting in reliable wrapping up of the torn web.

In accordance with a feature of the invention, the diameters or the driven speeds of the capturing cylinders with the rubber blankets are fixed such that the circumferential speed of these cylinders is slightly greater than the circumferential speed of the printing cylinders, so that during normal operation the capturing cylinders furthermore raise the tension on the paper that is conventionally exerted at the downstream printing station and thus make it more uniform over the printing machine as a whole. In this case, the capturing rollers also act as a pull-off station, in contrast to the generally known pull-in or threading station. Undesirable smearing of the fresh ink on one or both of the capturing cylinders does not occur, because a registered re-printing of the printed subject matter from the rubber-blanketed capturing cylinders onto the web always takes place.

The invention will be described in detail below, in terms of an exemplary embodiment taken in conjunction with the drawing.

DRAWING

FIG. 1 is a schematic illustration of a four-color offset rotary printing machine for prime and verso printing, having the paper web capturing apparatus according to the invention; and FIG. 2 is an enlarged illustration of the paper web capturing apparatus.

DETAILED DESCRIPTION

Figure 1:
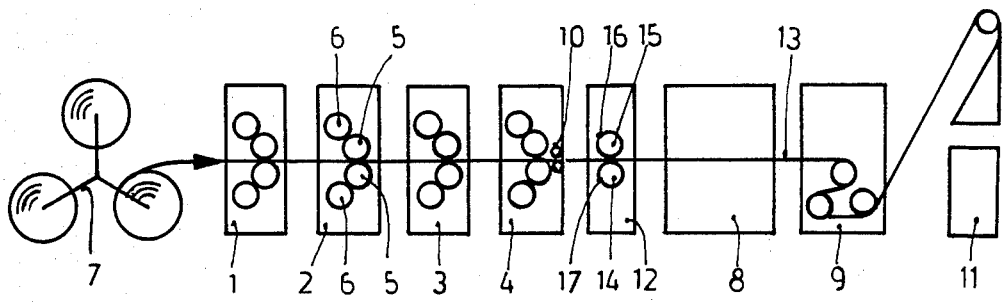
Figure 2:
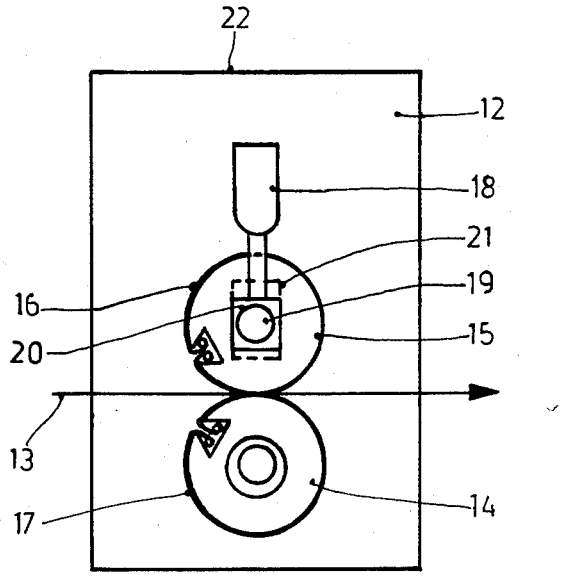

The offset rotary printing machine shown in FIG. 1 includes four printing stations 1, 2, 3 and 4 in a blanket-to-blanket arrangement (for prime and verso printing), each station having two rubber cylinders 5 and two plate cylinders 6; paper is supplied from a roll on a roll support spider 7; and a drier 8 is provided disposed following the printing stations 1–4, followed by a cooling station 9. A web tension monitoring apparatus 10 is located next to printing station 4. The cooling station 9 is followed by a folding device 11.

The paper web capturing apparatus 12 according to the invention is preferably disposed downstream of the last printing station 4, but upstream of the drier 8.

The paper web capturing apparatus 12 includes two cylinders 14, 15 disposed at opposite sides of the paper web 13 and serving as capturing rollers. The cylinders 14, 15 are each provided with an ink-accepting covering, such as a rubber blanket 16 and 17, respectively, which similarly to the rubber blankets used in offset machines are fastened thereon with the aid of tensioning devices, as well known, disposed in grooves or slots. Thus the cylinders 14, 15 serving as capturing cylinders may be of the same design and same size as the rubber cylinder 5 used in the printing stations.

The cylinders 14, 15 are in continuous engagement with the paper web 13. They are positioned resiliently against one another. The circumferential speed of the cylinders 14, 15 should preferably be somewhat greater in the range of parts per thousand than the circumferential speed of the printing station cylinders 5 and 6, as a result of which it is possible additionally to exert a tensioning effect on the paper web 13 during normal operation; this contributes to an increase in this range and thus to an evening out or averaging of the paper web tension in the entire printing machine. This can be accomplished, for instance, by placing a corresponding liner underneath the printing blankets 16, 17, thereby increasing the effective diameter thereof, or by means of a slightly increased operating speed. Naturally the somewhat increased circumferential speed of the cylinders 14, 15 must be set such that no perceptible smearing takes place on the printed paper web 13 as a consequence of slippage that occurs.

In the illustrated exemplary embodiment, the lower printing station cylinder 14 may be journalled in a stationary manner, as is conventional, for example in a conventional eccentric bearing, while the upper cylinder 15 is pressed in a pneumatically resilient manner against the lower printing station cylinder by means of a pneymatic cylinder 18. Thus in the event of tearing of the web, the torn paper web 13 can wrap itself about either the cylinder 14 or the cylinder 15, and because of the enlargement of the cylinder diameter caused by the wrapping process, the cylinder 15 will be deflected, so that no damage of any kind can be incurred by the cylinders 14, 15 and their bearings. The stubs 19 of the shafts of the cylinder 15 may for instance be journalled in slider blocks 20, which are displaceable in guides 21 in the side walls 22 by means of pneumatic cylinders.

OPERATION

Upon the occurrence of a tear in the web, there is no delay in the paper web capturing apparatus according to the invention, because the cylinders 14, 15 acting as capturing cylinders are continuously in engagement with one another, and the torn paper web can thus wrap itself immediately about one of the cylinders, an action which is further promoted by the fresh ink on the rubber blankets 16, 17. The functional reliability of the apparatus is thus greater than that of comparable, known capturing apparatus.

Since the cylinders 14, 15 covered with the rubber blankets 16, 17 have approximately the same diameter as do the cylinders 5, 6, the printed image is re-printed in registry from the cylinders 14, 15, i.e., from the rubber blankets 16, 17, onto the printed web 13, whereby an improvement in quality or in other words an enhancement of the resultant printing is attained during normal operation. Thus in addition to its capturing function in the event of tearing of the web, the paper web capturing apparatus according to the invention also performs two further functions during non-problematic, or normal, operation, namely (1) an enhancement of the printing, which is particularly noticeable if the paper web capturing apparatus is used in raised letter presses, and (2), the raising and hence improving, e.g., averaging, of the tension on the web, which has a particularly pronounced effect if the paper web capturing apparatus is disposed downstream of the last printing station.

Both the rubber cylinders of the printing stations 1–4 and the cylinders 14, 15 should in practice be disposed offset from the vertical (not shown in FIG. 1 for the sake of simplicity), thereby resulting in a slight looping about the cylinders on the part of the web.

In the form of embodiment shown in FIG. 1, the web 13 that is to be printed is printed on both sides. In this case, both of the cylinders 14, 15 must be provided with rubber blankets 16, 17. If the paper web capturing apparatus is used in machines in which a web of material can be printed on only one side, then it is sufficient for only one cylinder, the one that comes into contact with the printed side of the web, to be covered with a rubber blanket. The paper web capturing apparatus according to the invention can furthermore be used not only in printing machines for indirect printing (offset printing or indirect raised letter printing) but also in machines for direct printing (raised letter, flexographic or gravure printing).

It is within the scope of the invention, if desired, for the capturing cylinders to be fixedly positioned during problem-free operation, and for the positioning lock for this fixation to be released upon the occurrence of tearing of the web. The capturing rollers may also be equipped with bearer rings, so that upon the passage over clamping grooves a radial approach of the capturing cylinders, followed by undesired oscillations when the solid portion of the cylinders contact each other, is avoided.

I claim:

1. In a rotary printing machine system having at least one printing station (1, 2, 3, 4), each including at least one rotary printing cylinder (5) and a counter cylinder, for printing subject matter on a side of a substrate web;

apparatus to prevent damage to the printing cylinder or the counter cylinder, respectively, upon tearing of the web, located downstream—in the direction of travel of the web—of at least one printing station, having two paper capturing cylinders or rollers (14, 15) located at opposite sides of the web (13), wherein the paper capturing cylinders or rollers (14, 15) are in a continuous resilient engagement, with the web (13) interposed therebetween both during normal printing by the at least one printing system as well as upon tearing of the web;

both rollers (14, 15) are driven with a circumferential speed which is at least approximately equal to the linear speed of the web;

at least that one of the capturing cylinder or roller which faces the printed subject matter has the same diameter as the printing cylinder;

and wherein that one of the capturing cylinder or roller which is in engagement with the side of the web which has received printed information at the at least one printing station has a surface which is ink-and-printed-information-accepting.

2. Apparatus according to claim 1, wherein the circumferential speed of the cylinders (14, 15) is slightly greater than the circumferential speed of the printing station cylinders (5, 6).

3. Apparatus according to claim 1, wherein the rotary printing machine (FIG. 1) is a prime-and-verso printing machine, and both capturing cylinders or rollers (14, 15) are covered with rubber blankets (16, 17) and have the same diameters.

4. Apparatus according to claim 3, wherein the web-fed rotary printing machine is an offset machine having at least one rubber blanket cylinder;

and wherein the paper capturing cylinders or rollers (14, 15) are of the same diameter and the same design as said at least one rubber blanket cylinder of the offset printing machine.

* * * * *